US007829826B2

(12) United States Patent
Arens et al.

(10) Patent No.: US 7,829,826 B2
(45) Date of Patent: Nov. 9, 2010

(54) ELECTRIC HEATER FOR A CLOTHES DRYER

(75) Inventors: Helmut Arens, Herxheim (DE); Jürgen Stritzinger, Freckenfeld (DE); Helmut Nauerth, Niederhorbach (DE); Andreas Müller, Rheinzabern (DE)

(73) Assignee: Eichenauer Heizelemente GmbH & Co. KG, Kandel (DE)

( * ) Notice: Subject to any disclaimer, the term of this patent is extended or adjusted under 35 U.S.C. 154(b) by 818 days.

(21) Appl. No.: 11/789,364

(22) Filed: Apr. 24, 2007

(65) Prior Publication Data

US 2007/0278211 A1 Dec. 6, 2007

(30) Foreign Application Priority Data

Jun. 5, 2006 (CA) ..... 2549442

(51) Int. Cl.
*H05B 3/06* (2006.01)
*H01C 3/14* (2006.01)

(52) U.S. Cl. ..... 219/536; 219/461.1; 219/467.1; 219/532; 338/304; 338/305; 338/317; 338/318; 338/315; 174/138 G; 174/138 J; 174/167

(58) Field of Classification Search ..... 219/536, 219/461.1, 467.1, 532; 338/304–5, 317–8, 338/315; 174/138 G, 138 J, 167
See application file for complete search history.

(56) References Cited

FOREIGN PATENT DOCUMENTS

| | | | |
|---|---|---|---|
| CA | 2273473 | | 11/2000 |
| CA | 2308763 | * | 11/2001 |
| DE | 1 185 743 | | 1/1965 |
| DE | 27 09 413 | C3 | 11/1979 |

* cited by examiner

*Primary Examiner*—Shawntina Fuqua
(74) *Attorney, Agent, or Firm*—Walter A. Hackler

(57) ABSTRACT

The invention refers to an electric heater for a clothes dryer, said heater comprising at least one heating wire, a ring shaped support structure carrying the at least one heating wire. The at least one heating wire is a flat wire bent into loops.

17 Claims, 2 Drawing Sheets

ELECTRIC HEATER FOR A CLOTHES DRYER

FIELD OF THE INVENTION

The invention relates to an electric heater for a clothes dryer, said heater comprising at least one heating wire and a ring shaped support structure carrying the at least one heating wire.

BACKGROUND OF THE INVENTION

An electric heater for a clothes dryer is disclosed in the Canadian Patent 2308763. The known electric heater has a coil-shaped, i.e. helically wound, heating wire, which is mounted on a support structure. Although such electric heaters with coil-shaped heating wires are commonly used in clothes dryers, such heaters have disadvantages. In order to provide sufficient heating power, i.e. of more than 5 kW, rather large heaters are necessary. A further disadvantage is that increased air flow through coil-shaped heating wires may cause them to vibrate and thus create annoying noise. Coil-shaped heating wires tend to sag, collect fluff and their breaking may cause shorts.

There is a need to provide a compact heater for a clothes dryer, which can be cost efficiently manufactured and has a reduced tendency of the heating wire to vibrate.

SUMMARY OF THE INVENTION

It is therefore an object of the present invention to provide a compact electric heater for a clothes dryer.

This object is met by an electric heater for a clothes dryer, said heater comprising at least one heating wire and a ring shaped support structure carrying the at least one heating wire which is a flat wire bent into loops.

It has been found that a flat heating wire bent into loops can provide a higher heating power than a coil-shaped heating wire of same size. A flat heating wire has a larger surface area than a coil-shaped heating wire of comparable dimensions and can therefore transfer heat more efficiently to a surrounding air flow. Hence, an electric heater according to the present invention can stand higher electrical power, i.e. a higher current, without overheating. A further advantage of a flat wire bent into loops is that it collects less fluff and has a much smaller tendency to vibrate than coil-shaped wires.

The loops of a heater according to the present invention may, for example, form a zigzag shape or meandering pattern. A loop of the electric heater according to the present invention comprises a curving or doubling of the heating wire so as to form a partly open curve.

Further details and advantages of the invention will be apparent from a reading of the following detailed description of embodiments of the invention and a review of the associated drawings.

DETAILED DESCRIPTION

Figure 1:
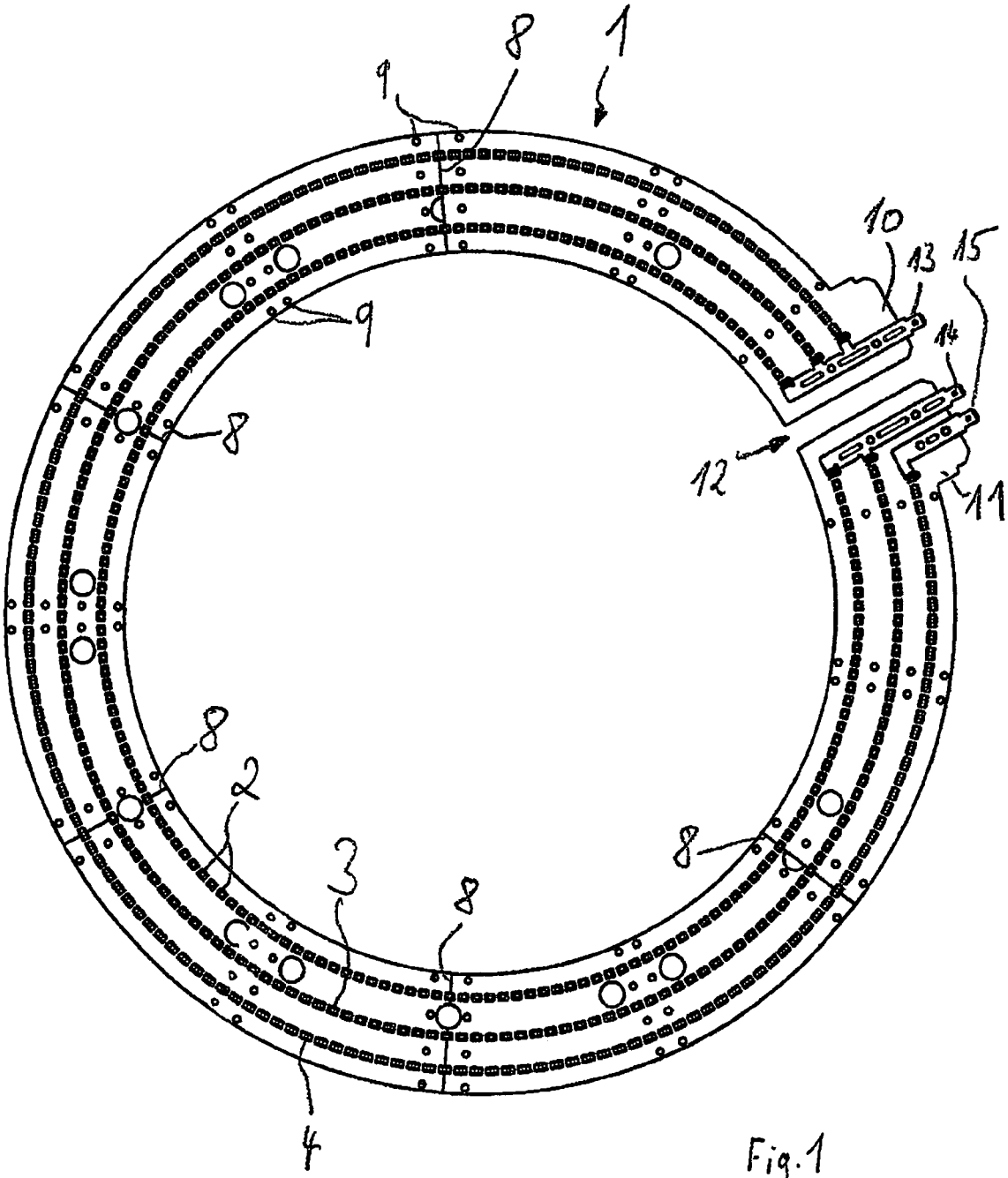
FIG. 1 shows an embodiment of the support structure of an electric heater according to the present invention.

FIG. 1 shows an embodiment of a ring shaped support structure 1 of an electric heater for a clothes dryer. The support structure 1 is made of an electrically insulating material, e.g. mica, and has holes 2, 3, 4 for loops of the heating wire. The holes 2, 3, 4 are arranged in concentric circles.

The number of circles corresponds to the number of heating wires of the electric heater for which the support structure 1 is intended. An electric heater with three heating wires is especially advantageous, although in principal a single heating wire is sufficient or more than three heating wires may also be used.

Figure 2:
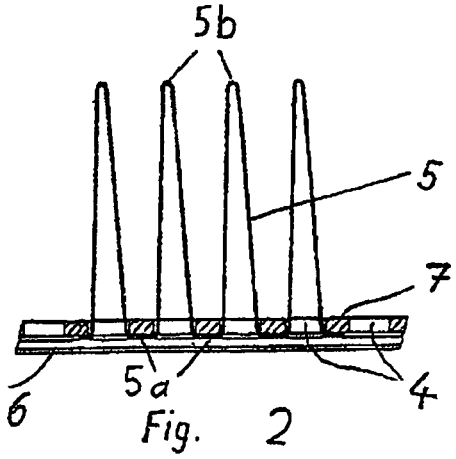
FIG. 2 shows a cross section view of an embodiment of the invention with a support structure according to FIG. 1.

FIG. 2 shows an embodiment of an electric heater in a cross section view along the circle on which the holes 4 are arranged. As can been seen, the heating wire 5 of the electric heater is bent into loops or folds which form the zigs and zags of a zigzag shape and protrude through the holes 2, 3, 4. The zigzag shape has lower apexes 5*a*, which are connected to the support structure 1, and upper apexes 5*b*, which are distanced from the support structure 1. By fixing the lower apexes 5*b* at the support structure 1 sagging of the wire and, even in case of its breaking, shorts are prevented.

The support structure 1 comprises a lower ring shaped support plate 6 and an upper ring shaped support plate 7, each made of an electrically insulating material, e.g. mica. The lower support plate 6 and the upper support plate 7 are arranged on top of each other. As shown in FIG. 2, the lower apexes 5*a* are arranged between the upper support plate 7 and the lower support plate 6.

In this way the lower ring shaped support plate 6 and the upper ring shaped support plate 7 facilitate assembly of the electric heater as loops of the flat heating wire 5 are simply stuck into holes 2, 3, 4 of the upper support plate 7. By connecting the upper support plate 7 and the lower support plate 6 with each other, the heating wire 5 is fixed into place. The upper and lower support plate 6, 7 provide electrical insulation and prevent loops of the heating wire 5 from touching each other or parts of a clothes dryer after installation of the heater therein.

The loops of the heating wire 5 are arranged in standing fashion on the support structure 1, preferably in such a way that they are aligned perpendicular with respect to the upper support plate 7. Loops of flat heating wire 5 arranged in this way can resist even a strong air flow without beginning to vibrate noticeably. Any vibrations are dampened by contact of the lower apexes 5*b* to the support structure 1. It is especially advantageous if the loops of the flat heating wire 5 are arranged in such a way, that the edge of the heating wire 5 faces in the radial direction of the support structure 1. In this way a radial air flow, which is to be heated by the heater, is exposed to a favourably large surface which allows for efficient heat transfer.

Figure 3:
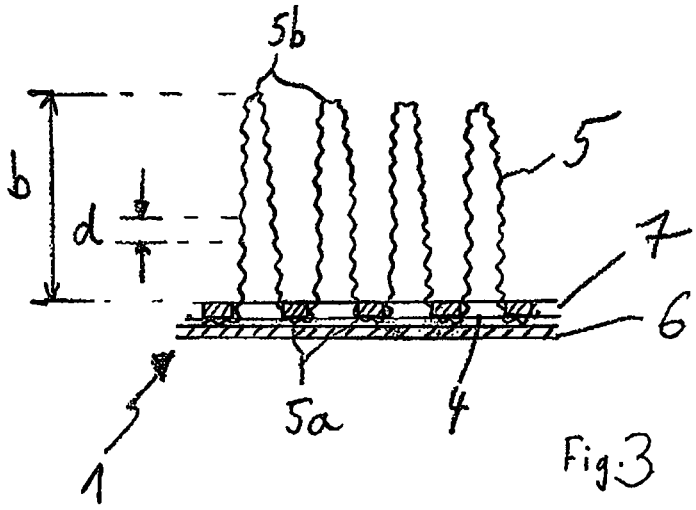
FIG. 3 shows a cross section view a different embodiment of the invention with a support structure according to FIG. 1.

FIG. 3 shows a second embodiment of the invention which differs from the embodiment shown in FIG. 2 in that the flat heating wire 5 is corrugated. Corrugated wire has the advantages of providing an increased surface area with much shorter loops, i.e. the height of the heater can be reduced without reduction of heating power. A corrugated wire thus makes it possible to provide a more compact heater. Neighbouring corrugations on the corrugated wire 5 have a distance d which is at least three times smaller than the distance b of the upper apexes 5*b* of the loops from the support structure 1, preferably at least 5 times smaller. In the example shown there are about nine to ten corrugations on one half of the loops, i.e. the distance d between neighbouring corrugations is nine to ten times smaller than the distance b of the upper apexes 5*b* of the folds from the support structure 1.

The distance between neighbouring holes 2, 3, 4 through which neighbouring loops of heating wire 5 protrude is larger than the distance d between neighbouring corrugations, preferably, between 2*d* and 4*d*. The distance between the lower support plate 6 and the upper support plate 7 is preferably smaller than the height of the corrugations, i.e. the distance between top and bottom of corrugation ridges. This causes the wire 5 to touch the support structure 1 only in a very small area. Thus, only very little heat is transferred to the support structure 1.

As can been seen in FIG. 1 the upper support plate 7 is assembled of several ring section pieces which are connected at junctures 8. Likewise the lower support plate 6 is also assembled of several ring section pieces which are connected of such junctures 8. The use of section pieces, from which the upper and lower support plates 6, 7 are assembled, provides for very cost efficient manufacturing as such section pieces can be cut from a sheet with much less waste than complete ring shaped support plates. In the embodiment shown in FIG. 1 the upper plate 7 comprises six, the lower support plate 6 seven section pieces. Although advantages regarding cost efficient manufacturing may be reaped by assembling a support plate from only two section pieces, it is advantageous to connect at least three section pieces each to form the upper support plate 7 and the lower support plate 6, preferably to connect at least 5 section pieces.

The junctures 8 of the upper support plate 7 are staggered with respect to the junctures (not shown) of the lower support plate 6. This provides for increased stability of the support structure 1. The ring section pieces of the upper and lower support plate 6, 7 have apertures 9 for connecting the section pieces by fastening means, for example, wire, brackets, clamps, clips, rivets or similar means. Staggering of the junctures 8 is most easily achieved by the use of different sized section pieces and/or a different number of section pieces for the upper and the lower support plate 6, 7. In the embodiment shown in FIG. 1 the junctures 8 of the upper support plate 7 are arranged in the middle of section pieces of the lower support plate. Likewise the junctures (not shown) of the lower support plate 6 are arranged in the middle of section pieces of the upper support plate 7.

As shown in FIG. 1 the support structure 1 is shaped as an open ring. The support structure 1 has two ends 10, 11, which are separated by a gap 12. The ends 10, 11 are provided with electrical terminals 13, 14, 15 for connection to a power supply. A support structure 1 which is shaped as an open ring can accommodate effects of thermal expansion by changes of the size of the gap 12 without causing any bending of the support structure 1. This is an important advantage as thermal expansion of the support structure 1 might otherwise cause movement of the heating wire 5 which could lead to unwanted contact and thereby to shorts or overheating and failure of the heating wire 5.

In the example shown in FIG. 1 the support structure 1 provides for parallel connections of two heating wires to a first terminal 14 and a separate second terminal 15 for a third heating wire. The terminal 13 on the other side of the gap 12 is intended for connection of all heating wires to ground potential. In this way the heating power can be switched on and off in three separate levels, i.e. only one heating wire arranged on the outer circle 4 connected to terminal 15, two heating wires arranged on the inner circles 2, 3 connected to terminal 14 or all three heating wires.

Figure 4:
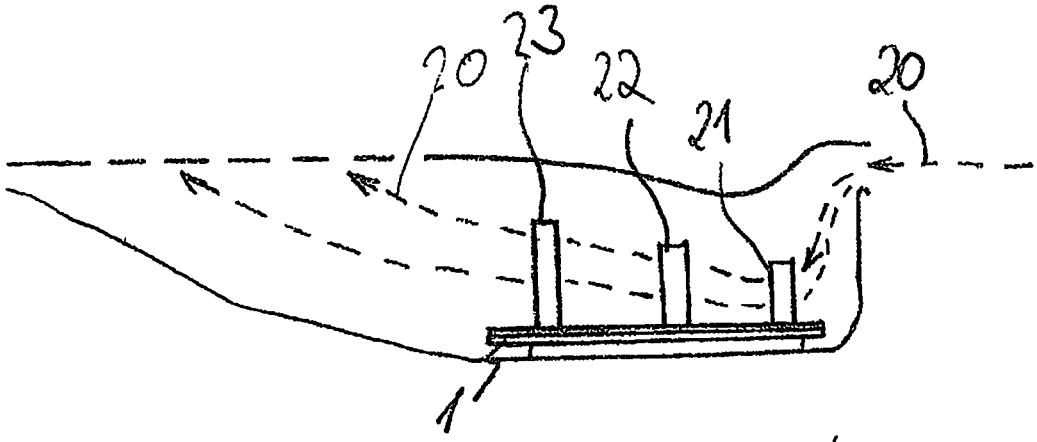
FIG. 4 shows schematically the air flow in a clothes dryer with a section of an embodiment of the invention.

FIG. 4 shows schematically the directions of air flow 20 with respect to the described heater when it is used in an electrical clothes dryer. Air flows in a radial direction over the support structure 1 and is heated thereby. This air flow, which is usually achieved by use of a suitable fan, typically opens out as it moves to the center of the ring shaped support structure 1 as indicated in FIG. 4. It has been found to be advantageous to adapt the length of the loops of the heating wires 5 accordingly. Hence, it is advantageous if the length of loops of the heating wire 5, i.e. the distance b of their upper apex 5*b* from the support structure 1, is larger for heating wires arranged in inner circles than in other circles. In the example shown the loops 21 of a first heating wire have a length different from the loops 22 of a second heating wire. In the example shown in FIG. 3 loops 21 are arranged on the outer circle of holes 4 of FIG. 1, loops 22 on the middle circle of holes 3 loops 23 on the inner circle of holes 2. For good effect the length of the loops of different heating wires should differ preferably by at least 10%, especially at least 20%. In the example shown loops 22 are about 40% larger than loops 21. Loops 23 are about 70% larger than loops 21.

The flat heating wire 5 used in the described embodiment of the electrical heater has a width of at least of 2 mm, preferably 2.4 mm to 3 mm. Good mechanical stability is achieved by a flat heating wire 5 which has a width which is at lest five times its thickness. The heating wire is made of a an iron chrome alloy, especially an iron chrome nickel or iron chrome aluminum alloy. Especially advantageous is a chrome content of 15 wt. % to 25 wt. % and an aluminium content of 3 wt. % to 8 wt. % or a nickel content of 20 wt. % to 30 wt. %, respectively. The heating wire of the described embodiment was made of an iron chrome aluminum alloy with a chrome content of 22 wt. % and an aluminum content of 5 wt. %.

The invention claimed is:

1. An electric heater for a clothes dryer, said heater comprising:

at least one heating wire, a ring shaped support structure carrying the at least one heating wire, the ring shaped support structure having a lower ring shaped support plate and an upper ring shaped support plate arranged on top of each other characterized in that the at least one heating wire is a flat wire bent into a loops shape.

2. Heater according to claim 1, wherein the loops each have a lower apex, which is connected to the support structure, and an upper apex, which is distanced from the support structure.

3. Heater according to claim 1 wherein the at least one wire is corrugated.

4. Heater according to claim 3, wherein neighbouring corrugations on the corrugated wire have a distance which is at least three times smaller than the distance of the upper apexes of the loops from the support structure.

5. Heater according to claim 1, wherein the upper support plate has holes through which the heating wire protrudes.

6. Heater according to claim 1, wherein the lower apexes of the loops are arranged between the upper support plate and the lower support plate.

7. Heater according to claim 1, wherein the upper support plate and the lower support plate are each assembled of several ring section pieces which are connected at junctures.

8. Heater according to claim 7, wherein the junctures of the upper support plate are staggered with respect to the junctures of the lower support plate.

9. Heater according to claim 7, wherein the ring sections have apertures for connecting the section pieces by fastening means.

10. Heater according to claim 1, wherein the flat heating wire has a width of at least 2 mm.

11. Heater according to claim 1, wherein the flat heating wire has a width which is at least 5 times its thickness.

12. Heater according to claim 1, wherein the support structure is shaped as an open ring.

13. Heater according to claim 1, wherein the at least one heating wire is made of an iron chrome alloy.

14. Heater according to claim 13, wherein the iron chrome alloy is an iron chrome aluminum or iron chrome nickel alloy.

15. Heater according to claim 1, wherein the heating wires are arranged in concentric circles.

16. An electric heater for a clothes dryer, said heater comprising:

at least one heating wire, a ring shaped support structure carrying the at least one heating wire, the structure carrying several heating wires wherein two heating wires are connected in parallel to a first terminal and a third heating wire is connected to a second terminal, characterized in that the at least one heating wire is a flat wire bent into a loops shape.

17. Heater according claim 16, wherein the loops of a first heating wire have a length different from the length of loops of a second heating wire.

* * * * *